US006208123B1

(12) United States Patent
Sudo

(10) Patent No.: US 6,208,123 B1
(45) Date of Patent: Mar. 27, 2001

(54) VOLTAGE REGULATOR WITH CLAMP CIRCUIT

(75) Inventor: Minoru Sudo, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/237,231

(22) Filed: Jan. 26, 1999

(30) Foreign Application Priority Data

Feb. 4, 1998 (JP) ..... 10-023681

(51) Int. Cl.[7] ..... G05F 1/40
(52) U.S. Cl. ..... 323/280
(58) Field of Search ..... 323/279, 280, 323/281, 316

(56) References Cited

U.S. PATENT DOCUMENTS

| | | | | |
|---|---|---|---|---|
| 4,929,883 | * | 5/1990 | Chieli | 323/282 |
| 4,952,863 | * | 8/1990 | Sartwell et al. | 323/280 |
| 5,381,082 | * | 1/1995 | Schlicht | 323/280 |
| 5,686,820 | * | 11/1997 | Riggio, Jr. | 323/273 |
| 5,920,182 | * | 7/1999 | Migliavacca | 323/282 |

* cited by examiner

*Primary Examiner*—Shawn Riley
(74) *Attorney, Agent, or Firm*—Adams & Wilks

(57) ABSTRACT

Current drawn from a power supply at the start-up of a voltage regulator is reduced by providing a clamp circuit to clamp the input voltage of an output transistor in the voltage regulator for a predetermined period of time after start-up. The voltage regulator preferably comprises an error amplifier for producing an error signal depending upon the difference between a divided portion of the regulated output voltage and a reference voltage, the error signal for controlling the output transistor to regulate the output voltage thereof, and the clamp circuit includes a charge storage device connected to a current source, and a switch circuit having a first terminal connected to a first voltage sufficient to place the output transistor in a high-resistance state, a second terminal connected to the error signal and the input of the output transistor, and a third terminal connected to the charge storage device for controlling an ON/OFF state of the switch circuit. When the voltage regulator is started, the voltage at the input of the output transistor is clamped to a voltage sufficient to maintain the output transistor in a high-resistance state for a predetermined period of time until the voltage across the charge storage device is brought by the current source to a voltage sufficient to activate the switch circuit so that the voltage at the input terminal of the output transistor is no longer clamped and is controlled by the error signal.

31 Claims, 6 Drawing Sheets

VOLTAGE REGULATOR WITH CLAMP CIRCUIT

BACKGROUND OF THE INVENTION

The present invention relates to a voltage regulator (hereinafter referred to as "V/R") which is capable of preventing a large current from flowing in a power supply when the V/R starts (this is a state in which an input voltage is applied to the V/R).

As a conventional V/R, there has been known a V/R shown in a circuit diagram of FIG. 6. That is, the conventional V/R is made up of a V/R control circuit formed of an error amplifier circuit 13 that compares and amplifies a differential voltage between a reference voltage Vref of a reference voltage circuit 10 and a voltage at a node of bleeder resistors 11 and 12 that divide a voltage (hereinafter referred to as "output voltage") Vout of an output terminal 5 of the V/R, and an output transistor 14. Assuming that an output voltage of the error amplifier 13 is Verr, an output voltage of the reference voltage circuit 10 is Vref and a voltage at the node between the bleeder resistors 11 and 12 is Va, if Vref>Va, Verr becomes low, but if Vref<Va, Verr becomes high.

When Verr becomes low, a voltage between the gate and the source of the output transistor 14 becomes large because the output transistor 14, in this case, is a p-channel MOS transistor, and the on-resistance becomes low so that the output voltage Vout rises, but conversely when Verr becomes high, the on-resistance of the output transistor 14 is made high so that the output voltage is lowered, to hold the output voltage Vout to a given voltage.

In general, in the V/R, since the output voltage Vout is lower than a desired voltage at the start of starting operation, the output Verr of the error amplifier 13 becomes a minimum value in order to make the output voltage high, to control the on-resistance of the output transistor 14 so as to be very small.

However, the conventional V/R suffers from a problem in that a large current flows in a power supply at the start of operation to cause damage to the power supply or the output transistor.

Therefore, in order to solve this problem with the conventional V/R, an object of the present invention is to clamp the output voltage of an error amplifier at the time of starting a V/R to inhibit the on-resistance of an output transistor from becoming very small, thereby suppressing a current to a power supply and a current to the output transistor at the time of starting the V/R.

SUMMARY OF THE INVENTION

In order to solve the above problem, according to the present invention, in a control circuit of the V/R, an output from the error amplifier is clamped at the time of starting the V/R, thereby being capable of suppressing a current from the power supply and a current from the output transistor.

DETAILED DESCRIPTION

The current to the power supply and the current to the output transistor at the time of starting the V/R are suppressed by clamping the output of the error amplifier to inhibit the output transistor from being in a low-resistance state.

Figure 1:
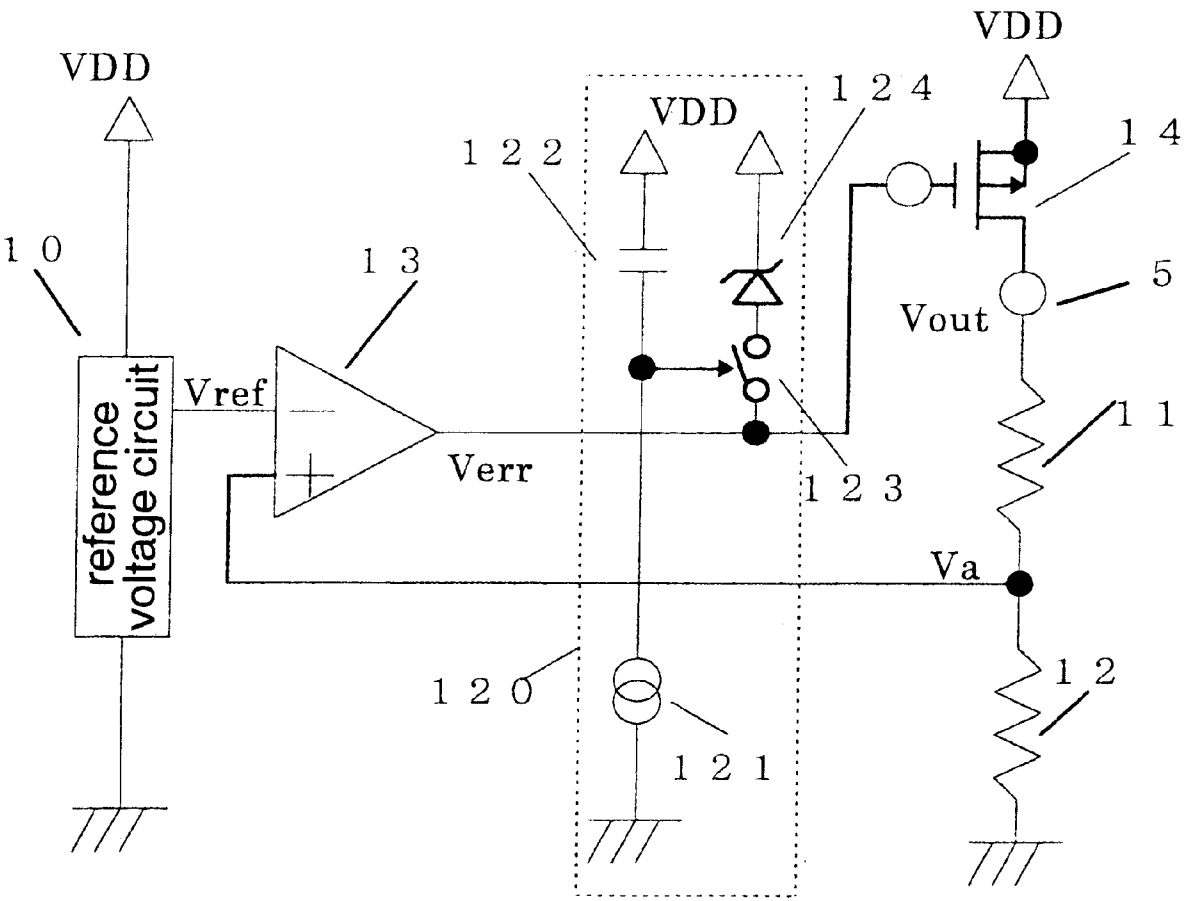
FIG. 1 is an explanatory diagram showing a V/R circuit in accordance with a first embodiment of the present invention.

Hereinafter, an embodiment mode of the present invention will be described with reference to the drawings. FIG. 1 is a diagram showing a V/R circuit in accordance with a first embodiment of the present invention. A reference voltage circuit 10, bleeder resistors 11 and 12, an error amplifier circuit 13 and an output transistor 14 are identical with those used in the conventional V/R circuit.

A clamp circuit 120 is added to the output of the error amplifier 13. The clamp circuit 120 is made up of a constant-current circuit 121, a capacitor 122, a switch 123 and a Zener diode 124. At the start of operation, the operation of charging the capacitor 122 starts with a current from the constant-current circuit 121, and the switch 123 is kept on until the capacitor 122 is charged to a given voltage.

Assuming that the Zener voltage across the Zener diode 124 is Vz, the output voltage Verr of the error amplifier 13 is clamped at VDD−Vz (clamp voltage) even if it is willing to be lower than a supply voltage VDD—the Zener voltage Vz, while the switch 123 is on.

Figure 2:
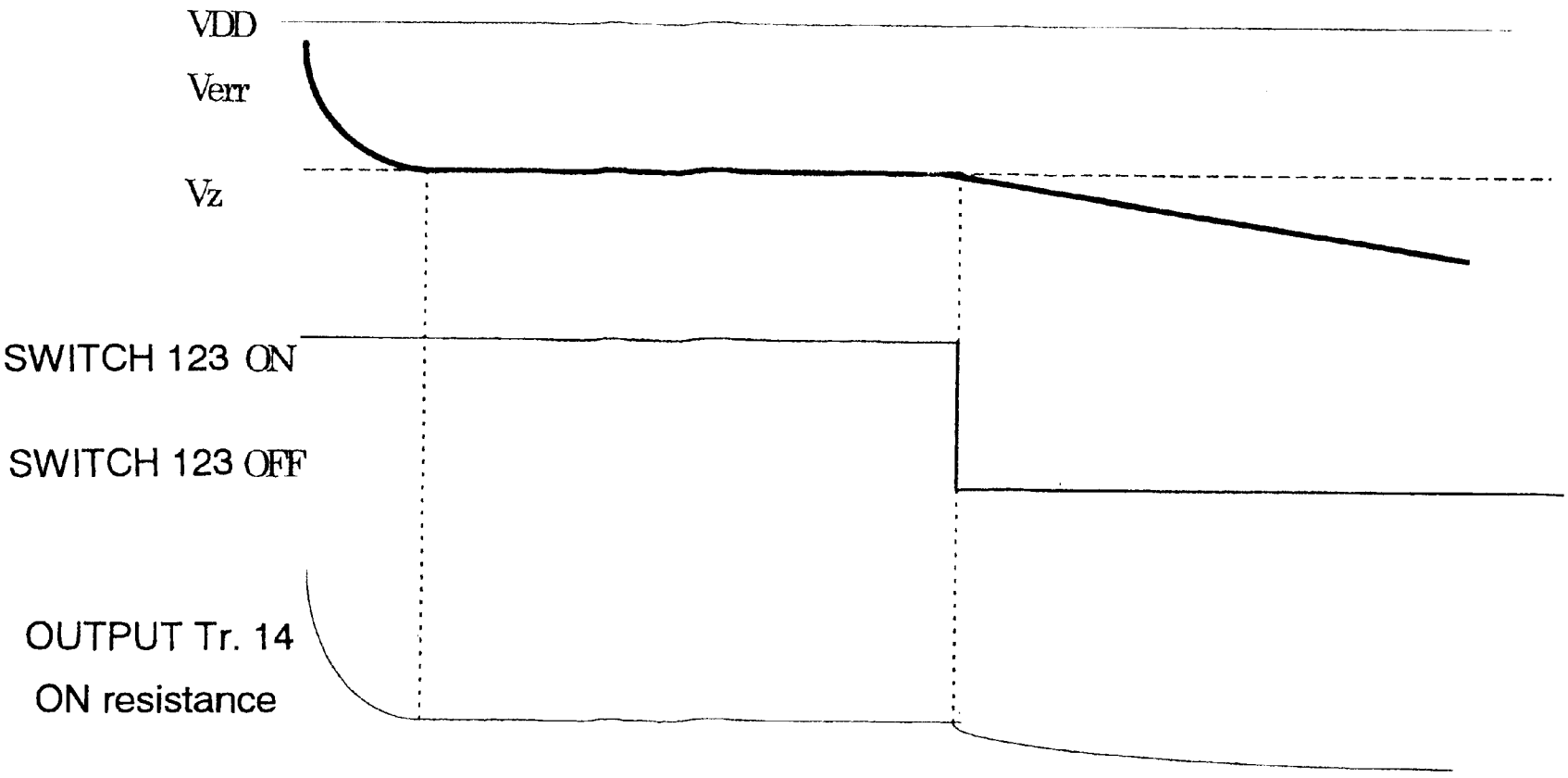
FIG. 2 is a diagram for explanation of the operation of the V/R circuit in accordance with the first embodiment of the present invention.

In other words, because the output voltage Verr of the error amplifier 13 is clamped at a voltage VDD−Vz during a given period where the switch 123 is on at the time of starting the V/R, since a voltage between the gate and the source is only Vz, the on-resistance of the output transistor 14 at this time becomes a certain on-resistance value. This is shown in FIG. 2 in which an axis of abscissa represents a time. The given period where the switch 123 is on is normally about several tens to several hundreds msec although it can be set arbitrarily depending upon a constant current value of the constant-current circuit 121 or the value of the capacitor 122.

In the case where there is provided no clamp circuit as in the conventional V/R, because a voltage VDD nearly equal to the supply voltage is applied between the gate and the source of the output transistor 14 at the time of starting the V/R, the on-resistance becomes very small.

Figure 3:
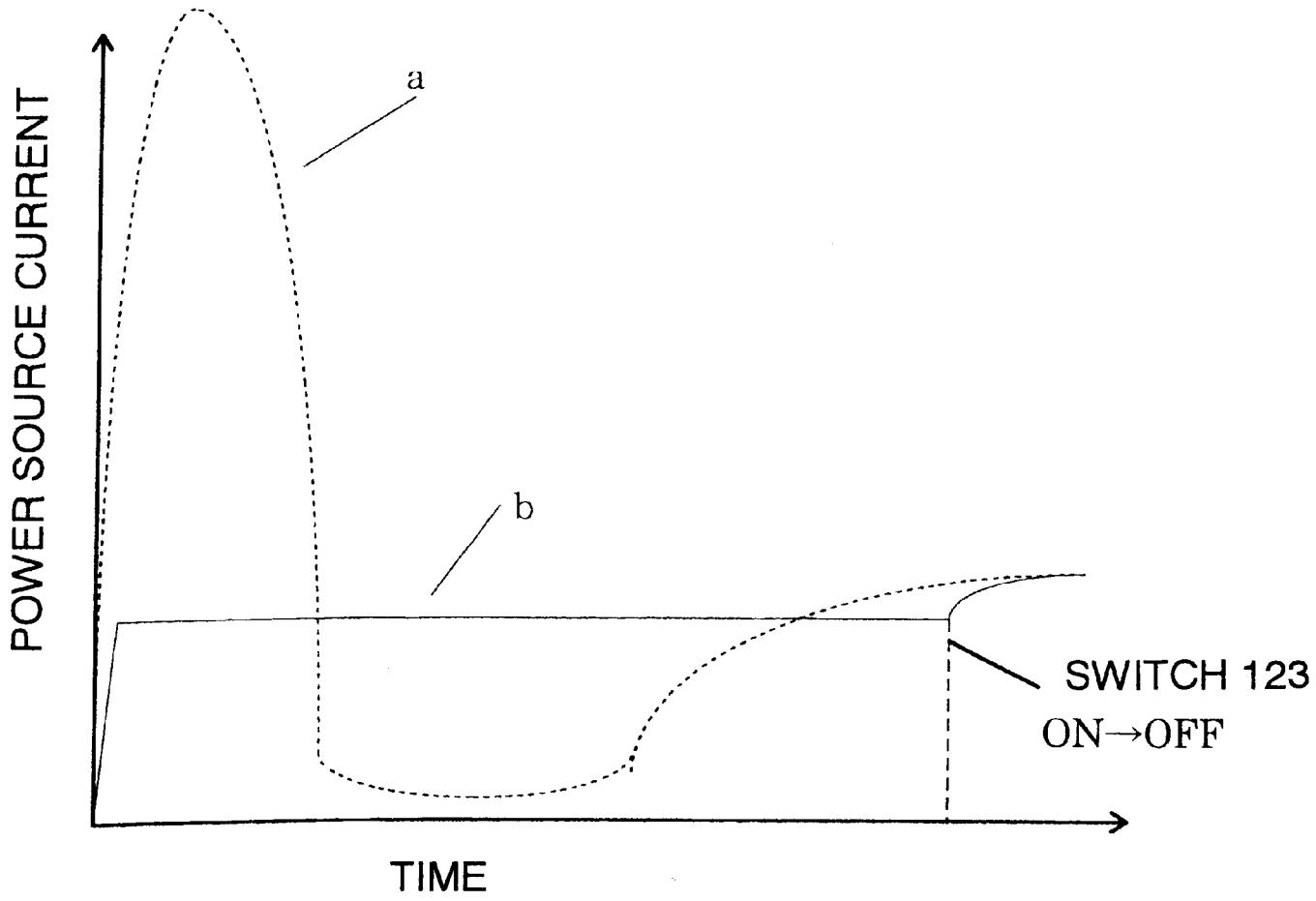
FIG. 3 is a diagram for explanation of the currents to the power supplies at the time of starting the V/R of the present invention and a conventional V/R.

The current to a power supply at the time of starting the V/R in case of the conventional V/R and the present invention are shown in FIG. 3. A broken line a indicates the current to the power supply in the conventional V/R whereas a solid line b indicates the current to the power supply in the V/R of the present invention. Also, an axis of abscissa represents a time whereas an axis of ordinate represents a current to the power supply. With the limitation of the on-resistance value of the output transistor at the time of starting the V/R, a maximum supply current value can be reduced to a small value.

By arbitrarily setting the clamp voltage, a load is charged at a given current value at the time of starting the V/R to enable the output voltage to rise.

In the above description, the Zener diode is used as means for clamping the output of the error amplifier.

However, it is apparent that the same effect is obtained even if, for example, a p-n junction diode, a MOS transistor connecting the gate and the drain (the connection of plural stages of MOS), or a clamp circuit made up of another circuit structure is used instead of the Zener diode.

Figure 4:
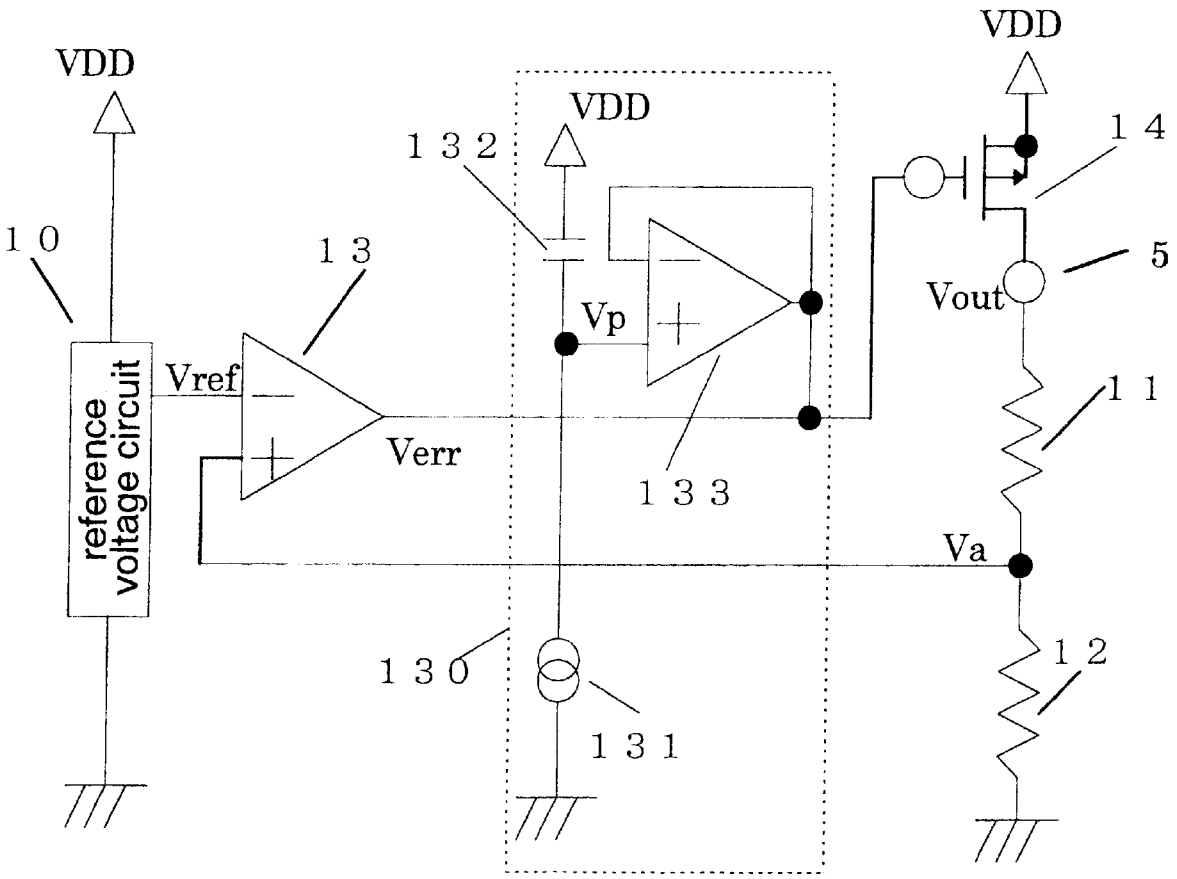
FIG. 4 is an explanatory diagram showing a V/R circuit in accordance with a second embodiment of the present invention.

FIG. 4 is a diagram showing a V/R circuit in accordance with a second embodiment of the present invention. A reference voltage circuit 10, bleeder resistors 11 and 12, an error amplifier 13 and an output transistor 14 are identical with those of the conventional V/R circuit described above. A difference from the first embodiment resides in that the clamp voltage of the clamp circuit in the error amplifier 13 varies in an analog manner as a time elapses. A clamp circuit 130 of the error amplifier 13 is made up of a constant-current circuit 131, a capacitor 132 and a voltage follower circuit 133.

The capacitor 132 is charged by the constant-current circuit 131 at the time of starting the V/R so that a voltage Vp at a plus terminal of the voltage follower circuit 133 drops gradually from the supply voltage VDD. Assuming that the output of the voltage follower circuit 133 has no sinking capability but only source-operating capability, the output voltage Verr of the error amplifier 13 drops gradually from the supply voltage VDD while being clamped by the output of the voltage follower circuit 133 at the time of starting the V/R.

In other words, since the on-resistance of the output transistor drops gradually from a large value at the time of starting the V/R, the maximum current value of a power supply at this time can be suppressed.

Figure 5:
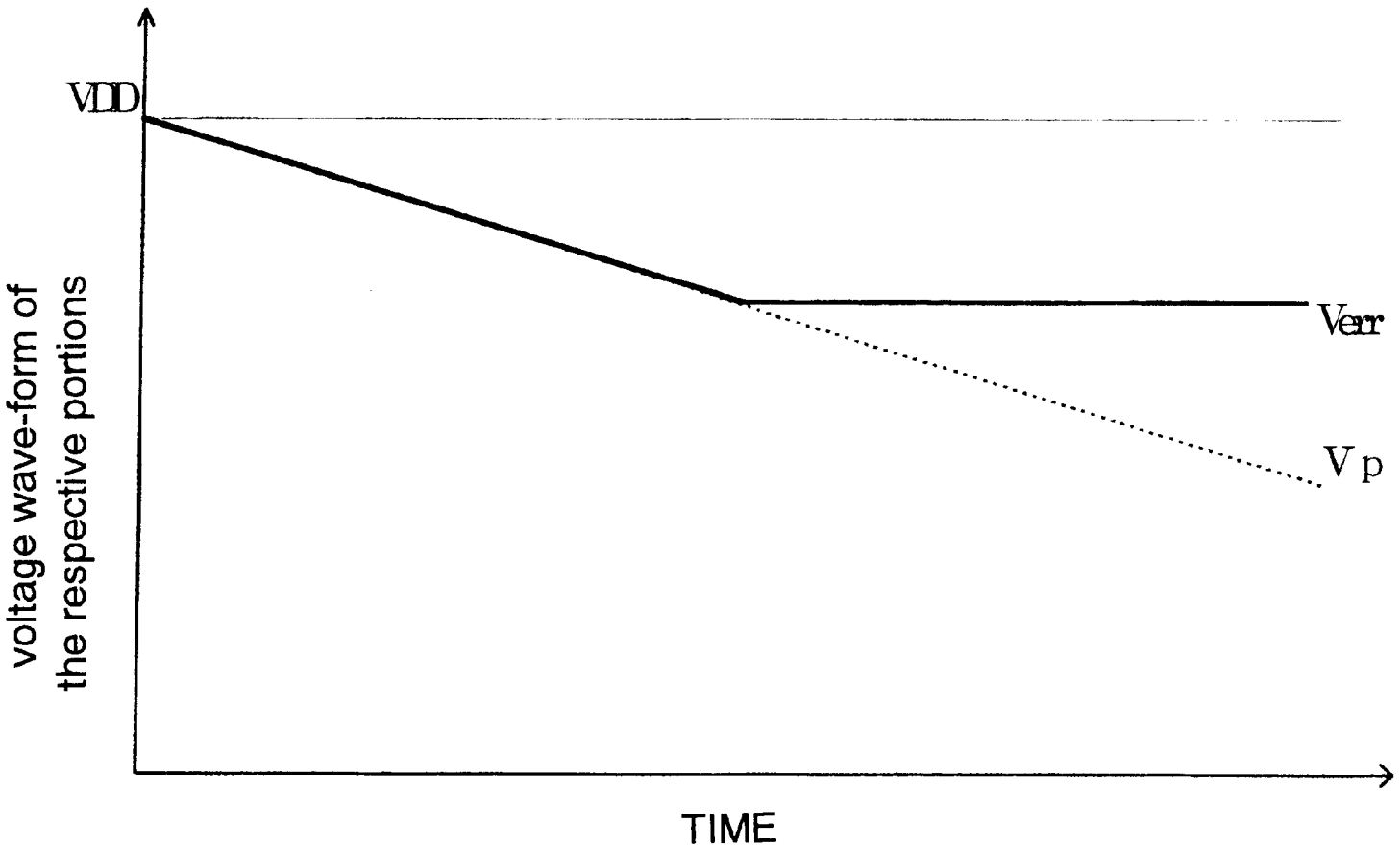
FIG. 5 is a diagram for explanation of the operation of the V/R circuit in accordance with the second embodiment of the present invention.
Figure 6:
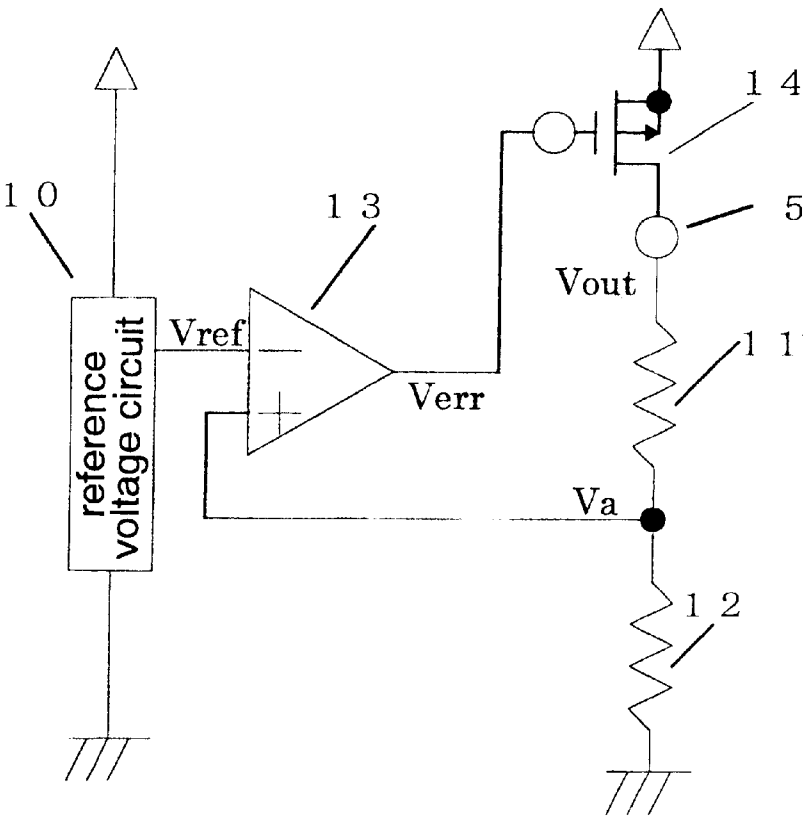
PRIOR ART Fig.6
FIG. 6 is an explanatory diagram showing a conventional V/R circuit.

FIG. 5 shows waveforms of the respective portions at the time of starting the V/R in accordance with the second embodiment of the present invention. An axis of abscissa represents a time whereas an axis of ordinate represents voltages at the respective portions.

The output of the voltage follower circuit 133 drops from VDD together with a voltage Vp of its plus terminal. During this, since the output voltage Verr of the error amplifier 13 is clamped by the voltage follower circuit 133, the on-resistance value of the output transistor of the V/R is suppressed to a certain value. In the meantime, when the voltage of Vp drops lower than the natural output voltage of the error amplifier, since the output of the voltage follower circuit 133 has no sinking capability, the same operation as that in the case where there is provided no clamp circuit is made.

In the embodiment of the present invention, although the output of the error amplifier is clamped at the time of starting the V/R, the same effect is obtained even in the case where, when there is a chip enable terminal (chip on/off terminal), the output of the error amplifier is clamped by its control signal without the limit of a case where the power supply turns on.

The V/R control circuit and V/R of the present invention has an advantage in that the current to the power supply at the time of starting the V/R can be suppressed by clamping the output of the error amplifier at the time of starting the V/R.

What is claimed is:

1. In a voltage regulator having at least an error amplifier and an output transistor for producing an output voltage, the improvement comprising: a clamp circuit for placing the output transistor in one of a high resistance state for a given period of time and a varying resistance state in which the on-resistance is reduced gradually as time elapses when the voltage regulator is placed in operation to thereby prevent the output transistor from turning on fully for the given period of time after the voltage regulator is placed in operation.

2. A voltage regulator according to claim 1; wherein the error amplifier produces an output signal based on a difference between a fed back portion of an output voltage of the output transistor and a reference voltage, the output signal of the error amplifier being supplied to an input terminal of the output transistor to regulate the output voltage of the output transistor; and wherein the clamp circuit comprises a charge storage device connected to a current source, and a switch circuit having a first terminal connected to a first voltage sufficient to place the output transistor in a high-resistance state, a second terminal connected to an output of the error amplifier and an input terminal of the output transistor, and a third terminal connected to the charge storage device for controlling an ON/OFF state of the switch circuit, such that when the voltage regulator is placed in operation, the voltage at the input terminal of the output transistor is clamped to a voltage level sufficient to maintain the output transistor in a high-resistance state for a predetermined period of time until the voltage across the charge storage device is brought by the current source to a voltage sufficient to activate the switch circuit so that the voltage at the input terminal of the output transistor is no longer clamped and is controlled by an output voltage of the error amplifier.

3. A voltage regulator according to claim 2; wherein the output transistor comprises a PMOS transistor, and the switch circuit comprises a switch element and a diode connected between a power source voltage and the input terminal of the output transistor, and wherein the switch circuit is ON when the voltage regulator is started such that the voltage at the input terminal of the output transistor is clamped to a voltage equal to the power source voltage minus the diode voltage and the output transistor is turned OFF, and the switch circuit is turned OFF when the charge storage device is changed to a voltage sufficient to open the switch so that the voltage at the input terminal of the output transistor is no longer clamped.

4. A voltage regulator according to claim 2; wherein the output transistor comprises a PMOS transistor, and the switch circuit comprises a voltage follower circuit having a first input terminal connected to a terminal of the charge storage device, a second input terminal connected to an output terminal of the voltage follower circuit and to the input terminal of the output transistor, the output terminal of the voltage follower circuit being further connected to the input terminal of the output transistor, such that when the voltage regulator is placed in operation, the output transistor is turned OFF so that no current flows therethrough, and the output transistor is turned ON a predetermined period of time thereafter, when the voltage of the charge storage reaches a predetermined voltage sufficient to alter an output voltage of the voltage follower.

5. A voltage regulator according to claim 1; wherein the error amplifier produces an output signal based on a difference between a fed back portion of an output voltage of the output transistor and a reference voltage, the output signal of the error amplifier being supplied to an input terminal of the output transistor to regulate the output voltage of the output transistor.

6. A voltage regulator according to claim 5; further comprising a reference voltage generating circuit for generating the reference voltage.

7. A voltage regulator according to claim 6; further comprising a resistor divider circuit for dividing an output voltage of the output transistor and feeding back the divided portion of the output voltage to the error amplifier.

8. A voltage regulator according to claim 1; wherein the error amplifier produces an output signal proportional to a difference between a fed back portion of an output voltage of the output transistor and a reference voltage, the output signal of the error amplifier being supplied to an input terminal of the output transistor to regulate the output voltage of the output transistor.

9. A voltage regulator according to claim 8; further comprising a reference voltage generating circuit for generating the reference voltage.

10. A voltage regulator circuit comprising: an output circuit for outputting a regulated output voltage; a comparison circuit for comparing a fed back portion of the regulated output voltage with a predetermined voltage and outputting a comparison signal dependent upon the comparison result; and a circuit for preventing current in the output circuit from reaching a maximum level for a predetermined period of time after the voltage regulator is placed in operation, the circuit comprising a clamp circuit for clamping the voltage supplied to a transistor in the output circuit to a predetermined value for a predetermined period of time after the voltage regulator is placed in operation so as to limit current flow in the transistor.

11. A voltage regulator circuit according to claim 10; wherein the comparison circuit comprises an error amplifier for comparing the fed back portion of the output voltage and the predetermined voltage and outputting an amplified error signal as the comparison signal, the error signal being proportional to the difference between the fed back portion of the output voltage and the predetermined voltage.

12. A voltage regulator circuit according to claim 10; wherein the comparison circuit comprises a circuit for subtracting one of the fed back portion of the output voltage and the predetermined voltage from the other one and producing an amplified difference signal as the comparison signal, the amplified difference signal being proportional to the difference between the fed back portion of the output voltage and the predetermined voltage.

13. A voltage regulator according to claim 10; wherein the clamp circuit comprises a charge storage device, a current source for charging and discharging the charge storage device, and a switch circuit connected to the charge storage device for opening a switch when the voltage of the charge storage device reaches the predetermined voltage so that the voltage applied to the transistor in the output circuit is no longer clamped.

14. A voltage regulator comprising: an error amplifier for producing an error signal based on a difference between a reference voltage and a fed back portion of a regulated output voltage of the voltage regulator; an output transistor for receiving the error signal for producing the regulated output voltage; and a clamp circuit for clamping the output voltage of the error amplifier to a given value to prevent the output transistor from being turned on for a given period of time exceeding a duration of a transient condition of the error amplifier after the voltage regulator is placed in operation.

15. A voltage regulator according to claim 14; wherein the clamp circuit places the output transistor in one of a high resistance state for a given period of time exceeding the duration of the transient period and a varying resistance state in which the on-resistance is reduced gradually as time elapses after the duration of the transient period when the voltage regulator starts.

16. A voltage regulator according to claim 15; wherein the error amplifier produces an output signal based on a difference between a fed back portion of an output voltage of the output transistor and a reference voltage, the output signal of the error amplifier being supplied to an input terminal of the output transistor to regulate the output voltage of the output transistor; and wherein the clamp circuit comprises a charge storage device connected to a current source, and a switch circuit having a first terminal connected to a first voltage sufficient to place the output transistor in a high-resistance state, a second terminal connected to an output of the error amplifier and an input terminal of the output transistor, and a third terminal connected to the charge storage device for controlling an ON/OFF state of the switch circuit, such that when the voltage regulator is started, the voltage at the input terminal of the output transistor is clamped to a voltage level sufficient to maintain the output transistor in a high-resistance state for a predetermined period of time exceeding the duration of the transient condition until the voltage across the charge storage device is brought by the current source to a voltage sufficient to activate the switch circuit so that the voltage at the input terminal of the output transistor is no longer clamped and is controlled by an output voltage of the error amplifier.

17. A voltage regulator according to claim 16; wherein the output transistor comprises a PMOS transistor, and the switch circuit comprises a switch element and a diode connected between a power source voltage and the input terminal of the output transistor, and wherein the switch circuit is ON when the voltage regulator is started such that the voltage at the input terminal of the output transistor is clamped to a voltage equal to the power source voltage minus the diode voltage and the output transistor is turned OFF, and the switch circuit is turned OFF when the charge storage device is changed to a voltage sufficient to open the switch so that the voltage at the input terminal of the output transistor is no longer clamped.

18. A voltage regulator according to claim 16; wherein the output transistor comprises a PMOS transistor, and the switch circuit comprises a voltage follower circuit having a first input terminal connected to a terminal of the charge storage device, a second input terminal connected to an output terminal of the voltage follower circuit and to the input terminal of the output transistor, the output terminal of the voltage follower circuit being further connected to the input terminal of the output transistor, such that when the voltage regulator starts, the output transistor is turned OFF so that no current flows therethrough, and the output transistor is turned ON a predetermined period of time thereafter, and after the duration of the transient period, when the voltage of the charge storage reaches a predetermined voltage sufficient to alter an output voltage of the voltage follower.

19. A voltage regulator according to claim 14; wherein the error amplifier produces an output signal based on a difference between a fed back portion of an output voltage of the output transistor and a reference voltage, the output signal of the error amplifier being supplied to an input terminal of the output transistor to regulate the output voltage of the output transistor.

20. A voltage regulator according to claim 19; further comprising a reference voltage generating circuit for generating the reference voltage.

21. A voltage regulator according to claim 20; further comprising a resistor divider circuit for dividing an output voltage of the output transistor and feeding back the divided portion of the output voltage to the error amplifier.

22. A voltage regulator according to claim 14; wherein the error amplifier produces an output signal proportional to a difference between the fed back portion of an output voltage of the output transistor and a reference voltage, the output signal of the error amplifier being supplied to an input terminal of the output transistor to regulate the output voltage of the output transistor.

23. In a voltage regulator having at least an error amplifier having a transient condition when placed in operation and an output transistor for producing an output voltage, the improvement comprising: a circuit for preventing the output transistor from turning on for a given period of time exceeding the duration of the transient condition after the voltage regulator is placed in operation, the circuit comprising a clamp circuit for placing the output transistor in one of a high resistance state for a given period of time exceeding the duration of the transient period and a varying resistance state in which the on-resistance is reduced gradually as time elapses after the duration of the transient period when the voltage regulator is placed in operation.

24. A voltage regulator according to claim 23; wherein the error amplifier produces an output signal based on a difference between a fed back portion of an output voltage of the output transistor and a reference voltage, the output signal of the error amplifier being supplied to an input terminal of the output transistor to regulate the output voltage of the output transistor; and wherein the clamp circuit comprises a charge storage device connected to a current source, and a switch circuit having a first terminal connected to a first voltage sufficient to place the output transistor in a high-resistance state, a second terminal connected to an output of the error amplifier and an input terminal of the output transistor, and a third terminal connected to the charge storage device for controlling an ON/OFF state of the switch circuit, such that when the voltage regulator is started, the voltage at the input terminal of the output transistor is clamped to a voltage level sufficient to maintain the output transistor in a high-resistance state for a predetermined period of time exceeding the duration of the transient condition until the voltage across the charge storage device is brought by the current source to a voltage sufficient to activate the switch circuit so that the voltage at the input terminal of the output transistor is no longer clamped and is controlled by an output voltage of the error amplifier.

25. A voltage regulator according to claim 24; wherein the output transistor comprises a PMOS transistor, and the switch circuit comprises a switch element and a diode connected between a power source voltage and the input terminal of the output transistor, and wherein the switch circuit is ON when the voltage regulator is placed in operation such that the voltage at the input terminal of the output transistor is clamped to a voltage equal to the power source voltage minus the diode voltage and the output transistor is turned OFF, and the switch circuit is turned OFF when the charge storage device is changed to a voltage sufficient to open the switch so that the voltage at the input terminal of the output transistor is no longer clamped.

26. A voltage regulator according to claim 24; wherein the output transistor comprises a PMOS transistor, and the switch circuit comprises a voltage follower circuit having a first input terminal connected to a terminal of the charge storage device, a second input terminal connected to an output terminal of the voltage follower circuit and to the input terminal of the output transistor, the output terminal of the voltage follower circuit being further connected to the input terminal of the output transistor, such that when the voltage regulator starts, the output transistor is turned OFF so that no current flows therethrough, and the output transistor is turned ON a predetermined period of time thereafter, and after the duration of the transient period, when the voltage of the charge storage reaches a predetermined voltage sufficient to alter an output voltage of the voltage follower.

27. A voltage regulator according to claim 23; wherein the error amplifier produces an output signal based on a difference between a fed back portion of an output voltage of the output transistor and a reference voltage, the output signal of the error amplifier being supplied to an input terminal of the output transistor to regulate the output voltage of the output transistor.

28. A voltage regulator according to claim 27; further comprising a reference voltage generating circuit for generating the reference voltage.

29. A voltage regulator according to claim 28; further comprising a resistor divider circuit for dividing an output voltage of the output transistor and feeding back the divided portion of the output voltage to the error amplifier.

30. A voltage regulator according to claim 23; wherein the error amplifier produces an output signal proportional to a difference between the fed back portion of an output voltage of the output transistor and a reference voltage, the output signal of the error amplifier being supplied to an input terminal of the output transistor to regulate the output voltage of the output transistor.

31. A voltage regulator according to claim 30; further comprising a reference voltage generating circuit for generating the reference voltage.

* * * * *